US006968690B2

(12) United States Patent
Kalina

(10) Patent No.: US 6,968,690 B2
(45) Date of Patent: Nov. 29, 2005

(54) POWER SYSTEM AND APPARATUS FOR UTILIZING WASTE HEAT

(75) Inventor: Alexander I. Kalina, Hillsborough, CA (US)

(73) Assignee: Kalex, LLC, Belmont, CA (US)

( * ) Notice: Subject to any disclaimer, the term of this patent is extended or adjusted under 35 U.S.C. 154(b) by 0 days.

(21) Appl. No.: 10/831,771

(22) Filed: Apr. 23, 2004

(65) Prior Publication Data

US 2005/0235645 A1 Oct. 27, 2005

(51) Int. Cl.[7] ..... F01K 25/06

(52) U.S. Cl. ..... 60/649; 60/651; 60/671

(58) Field of Search ..... 60/649, 651, 671

(56) References Cited

U.S. PATENT DOCUMENTS 5,572,871 A * 11/1996 Kalina ..... 60/649
6,058,695 A * 5/2000 Ranasinghe et al. ..... 60/39.182
6,065,280 A * 5/2000 Ranasinghe et al. ..... 60/774
6,202,418 B1 * 3/2001 Gabrielli et al. ..... 60/649

* cited by examiner

*Primary Examiner*—Hoang Nguyen

(57) ABSTRACT

A new Kalina thermodynamic cycle is disclosed where a multi-component working fluid is fully vaporized in a boiler utilizing waste heat streams such as flue gas streams from cement kilns so the energy can be extracted from the streams and converted to usable electrical or mechanical energy in a turbine subsystem and after extraction, the spent stream is fully condensed in a distillation-condensation subsystem using air and/or water coolant streams. A new method for implementing the improved Kalina thermodynamic cycle is also disclosed.

22 Claims, 3 Drawing Sheets

POWER SYSTEM AND APPARATUS FOR UTILIZING WASTE HEAT

BACKGROUND OF THE INVENTION

1. Field of the Invention

The present invention relates to a power system, apparatus and method for utilizing waste heat from high temperature application such as kilns, furnaces, incinerates, or other facilities that generate gas streams with utilizable thermal energy capable of conversion to electric energy. The process and system is designed to convert thermal energy (heat) into mechanical work and then to electrical power.

More particularly, the present invention relates to a power system, apparatus and method for utilizing waste heat from high temperature application such as kilns, furnaces, incinerates, or other facilities that generate gas streams with utilizable thermal energy capable of conversion to electric energy, where the system includes a two stage turbine subsystem, a distillation-condensation subsystem and a boiler subsystem in a multiple pressure thermodynamic cycle using a multi-component working fluid comprising at least one lower boiling component and at least one higher boiling components such as an ammonia-water working fluid.

2. Description of the Related Art

In the prior art there exists a system that uses as working fluid a mixture of at least two components, (preferably, an ammonia-water mixture). This system has demonstrated superior efficiency over the conventional Rankine cycle systems. Now referred to a the Kalina Cycle.

These systems comprise two major subsystem: the boiler-turbine subsystem and the distillation—condensation subsystem. However, these systems had some significant shortcomings. The distillation-condensation subsystem used only the higher temperature portion of the available heat from the turbine exhaust. The simplest distillation-condensation subsystem in the prior art required eight separate heat exchangers (see, e.g., U.S. Pat. No. 4,489,563) and did not utilize the lower temperature portion of the heat from the turbine exhaust.

More complex distillation-condensation systems did utilize this lower temperature portion of the heat of the turbine exhaust, but required several additional heat exchangers (see, e.g., U.S. Pat. No. 5,095,708).

In boilers of the prior art systems, a significant reduction of thermodynamical loses was achieved when it was possible to attain a perfect balance between the available heat and heat load in the low temperature portion of the boiler, (i.e., in the process of pre-heating the working fluid up to a boiling point temperature). 'This in its turn required that the initial temperature of the heat source be relatively high. In such cases where the initial temperature of a heat source is lower, then balancing of the available heat with the heat load in the high temperature portion of the boiler (i.e., the portion of the boiler where the vaporization and superheating of the working fluid occurs) leaves significant excess heat in the low temperature portion of the boiler, (i.e., the pre-heater). This excess heat is not only utilized, and this has an adverse effect on the overall efficiency of the system.

Moreover, in some cases, the gas which "carries" the heat to be utilized contains corrosive components. An example of this occurs with flue gas in cement kilns. In such a case, the gas cannot be cooled below a specific temperature, since if the gas is cooled to far, there would be a condensation of corrosive components of the gas on the surface of the heat exchanger, which would result in acute corrosion. Thus, the stream of working fluid must be pre-heated, since if the stream were to be too cool, and the pipes of the heat exchangers in which this working fluid is held were to be exposed to corrosive flue gas, then the result would be the condensation of some components of the flue gas on some of the components of the heat exchanger. In such a case, even in the bulk of the flue gas were to be at sufficiently high temperature, there would still be precipitation of corrosive materials onto the heat exchanger.

Thus, there is a need in the art for a new power system, apparatus and method designed to eliminate or ameliorate the shortcomings that exist in the prior art.

SUMMARY OF THE INVENTION

The present invention provides a the present invention relates to a power system, apparatus and method for utilizing waste heat from high temperature application such as kilns, furnaces, incinerates, or other facilities that generate gas streams with utilizable thermal energy capable of conversion to electric energy, where the system includes a two stage turbine subsystem, a distillation-condensation subsystem (DCSS) and a boiler subsystem (BSS) in a multi-pressure thermodynamic cycle using a multi-component working fluid comprising at least one lower boiling component and at least one higher boiling component such as an ammonia-water working fluid. The DCSS utilized either air or water or a combination of air and water streams to partially and or completely condense streams of the multi-component fluid having different compositions. The DCSS is a controlled to adapt to changes in conditions such as the temperature and composition of the incoming multi-component streams, the temperature of the air and/or water streams used to fully or partially condense one or more multi-component fluid streams having different compositions or a combination of changes in temperature and composition of the incoming streams and temperatures of the coolant streams. The temperature and composition of the incoming streams are affected by the temperature of the flue gas streams, waste heat streams, used to fully vaporize and superheat a working solution stream, while maintaining an initial conditions sufficient, sufficiently high inlet temperature, to prevent condensation of any corrosive component in the flue gas or waste heat stream on any surface of the boiler or boiler components. Thus, the DCSS adjusts to such changes in condition by increasing or decreasing certain stream flow rates, even decreasing some streams to zero flow rate. The BSS utilizes hot waste gas stream such as flue gas streams coming from kilns or furnaces to fully vaporize and superheat a working solution stream prior to its expansion in the turbine subsystem, and like the DCSS, the BSS is a controlled to adapt to changes in conditions of the working solution composition and temperature and in the temperature of the waste heat streams. Thus, the BSS adjusts to such changes in condition by increasing or decreasing certain stream flow rates, even decreasing some streams to zero flow.

The present invention also provides a system including a turbine subsystem having a high pressure portion, a low pressure portion and an intermediate extraction port, a distillation-condensation subsystem and a boiler subsystem in a multi-pressure thermodynamic cycle using a multi-component working fluid comprising at least on lower boiling component and at least one higher boiling component such as an ammonia-water working fluid, where the boiler transfers heat from at least one waste heat stream to two working solution streams to form a fully vaporized, superheated working solution stream and a partially vaporized working solution stream, the turbine subsystem expands the fully vaporized, superheated working solution stream converting the thermal energy to mechanical and/or electric energy. The partially vaporized working solution stream is separated in a separator into an enriched vapor stream and a lean liquid stream. The enriched vapor stream is mixed with a fully condensed liquid stream produced from the distillation-condensation subsystem forming a working solution stream, which is then divided into two streams each transferred to the boiler. If the enriched vapor stream is in excess to the amount of vapor that can be absorbed by the fully condensed liquid stream, the stream is split into two stream with one substream being mixed with the fully condensed liquid stream and the other passing through a throttle valve lower its pressure to the pressure of the spent working solution stream from the turbine subsystem. If there is insufficient enriched vapor stream to mix with the fully condensed liquid stream to heat it to a temperature sufficient to keep any corrosive components in the waste stream from condensing on surfaces of the boiler, then a vapor stream is extracted from an intermediate port of the turbine subsystem and combined with the enriched vapor stream. The resulting combined stream is then mixed with the fully condensed stream.

The present invention provides a distillation-condensation subsystem (DCSS) includes six heat exchangers adapted to condense an incoming multi-component fluid stream, four throttle valves adapted to adjust the pressure of up to four stream so that the streams can be mixed with other streams, three separators adapted to separate up to four mixed stream into vapor and liquid substreams, and up to six pumps for increasing the pressure of up to six stream and sufficient mixers and splitters adapted to combine or divide stream as needed. The DCSS is designed to input one or two multi-component streams each having a different composition, where the streams are derived from an energy extraction subsystem after a working solution stream is fully vaporized and superheated in a vaporization or boiler subsystem. The DCSS utilized either air or water or a combination of air and water streams to partially and or completely condense streams of the multi-component fluid having different compositions. The DCSS is a controlled to adapt to changes in conditions such as the temperature and composition of the incoming multi-component streams, the temperature of the air and/or water streams used to fully or partially condense one or more multi-component fluid streams having different compositions or a combination of changes in temperature and composition of the incoming streams and temperatures of the coolant streams. The temperature and composition of the incoming streams are affected by the temperature of the flue gas streams, waste heat streams, used to fully vaporize and superheat a working solution stream, while maintaining an initial conditions sufficient, sufficiently high inlet temperature, to prevent condensation of any corrosive component in the flue gas or waste heat stream on any surface of the boiler or boiler components. Thus, the DCSS adjusts to such changes in condition by increasing or decreasing certain stream flow rates, even decreasing some streams to zero flow rate.

The present invention provides a method for converting thermal energy to mechanical and/or electrical energy including the step of forming two stream of a working solution of a working fluid comprising at least one lower boiling component and at least one higher boiling component, preferably an ammonia-water mixture. The two streams are forwarded to a boiler, where one stream is fully vaporized and superheated and is forwarded through an admission valve to a turbine subsystem, where the stream is expanded producing mechanical and/or electrical energy producing a spent working solution stream. The second working solution streams is partially vaporized in a lower section of the boiler and forwarded to a separator. The separator separates the partially vaporized stream into a vapor stream and a liquid stream. The liquid stream passes through a throttle valve reducing its pressure to a pressure equal to or substantially equal to a pressure of the spent working solution stream and mixing the reduced pressure stream with the spent stream to form a leaner spent stream which is forwarded to a distillation-condensation subsystem (DCSS) for condensation. All or a portion of the vapor stream from the separator is forwarded to the initial working solution stream discharged from the DCSS to form the working solution stream. The amount of the vapor stream to be mixed with the initial working solution stream is dependent on the amount of vapor the initial working solution can accommodate and on the amount of heating required to ensure that the working solution stream resulting from the mixing of these two streams is sufficient to prevent condensation of any corrosive component of the waste heat stream on any surface in the boiler. If the vapor stream is insufficient for forming a working solution with such required parameters, the system extracts a stream from an intermediate port of the turbine subsystem and mixes the extracted stream with the vapor stream and the combined stream is then mixed with the initial working solution stream to form the working solution stream. If the vapor stream is in excess of the amount required to convert the initial working solution stream into the working solution stream with the required parameters, then the stream is split and an excess portion is forwarded to the DCSS after passing through a throttle value to lower its pressure. In the DCSS, the leaner spent stream and, if present, the excess portion of the vapor stream is mixed, split, pumped, expanded and cooled to generate a fully condensed DCSS output stream referred to as the initial working solution.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1A:
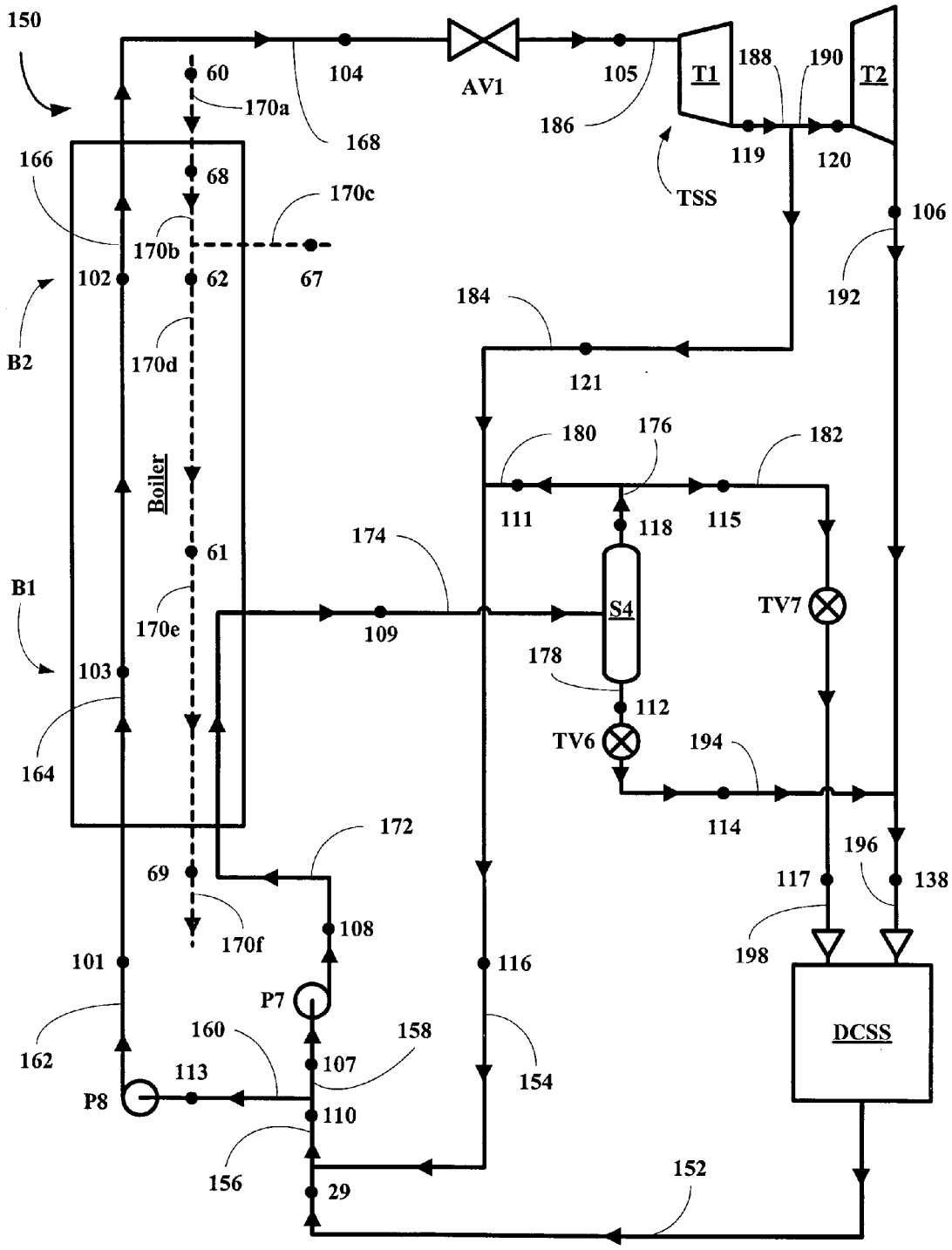
FIG. 1A depicts a block diagram of a preferred embodiment of a power system of this invention.

The inventor has found that new more efficient and simpler apparatus, system and method for extracting usable energy from high temperature waste stream, where the system includes a two stage turbine energy extraction subsystem, a distillation-condensation subsystem and a boiler subsystem in a two pressure thermodynamic cycle for converting thermal energy from hot waste streams into mechanical energy and then into electric energy.

The apparatus of this invention broadly relates to a system includes a boiler subsystem (BSS), a distillation-condensation subsystem (DCSS) and a turbine subsystem (TSS), where the BSS vaporizes (boils) and superheats a working solution stream comprising at least one lower boiling component and at least one high boiling component using heat from external waste heat streams containing corrosive components, which is forwarded through an admission valve to the TSS for energy extraction and conversion to usable mechanical and/or electrical energy. The DCSS condenses a spent stream and optionally an enriched vapor stream to form a fully condensed DCSS output stream having parameter that are referred to as the initial working solution, which is forwarded to the BSS for vaporization and energy extraction in the TSS. The BSS, TSS and DCSS are a controlled to adapt to changes in conditions such as the temperature and composition of the streams used by each subsystem, the temperature of the air and/or water streams used to fully or partially condense one or more multi-component fluid streams having different compositions, the temperature and number of flue gas stream or waste heat streams used to fully vaporize and superheat and partially vaporize working solution streams or a combination of changes in temperature and composition of the subsystem working streams, temperatures of the coolant streams and temperatures of the flue gas streams or waste heat streams. Thus, the BSS, TSS, and DCSS adjust to such changes in condition by increasing or decreasing certain stream flow rates, even decreasing some streams to a zero flow rate.

The system of this invention broadly relates to a method for extracting energy from waste heat streams such as flue gas streams from kilns or furnaces, where the method includes the step of fully vaporizing and superheating a working solution in a boiler subsystem (BSS), where the working solution comprising a composition including a system determined amount of a lower boiling component and a system determined amount of a higher boiling component. The fully vaporized and superheated working solution stream is then forwarded through an admission valve to a turbine subsystem (TSS) where the stream is expanded and a portion of its thermal energy is converted to usable mechanical and/or electrical energy producing a spent working solution stream. The spent working solution stream is then mixed with a reduced pressure, separated liquid stream and forwarded along with an optional excess portion of a separated vapor stream to a distillation-condensation subsystem to produce a fully condensed liquid stream comprising a different composition of the lower boiling component and the higher boiling component referred to as an initial working solution and leaner than the composition of the working solution.

The working fluid used in the systems of this inventions is a multi-component fluid that comprises a lower boiling point material—the low-boiling component—and a higher boiling point material—the high-boiling component. Preferred working fluids include, without limitation, an ammonia-water mixture, a mixture of two or more hydrocarbons, a mixture of two or more freons, a mixture of hydrocarbons and freons, or the like. In general, the fluid can comprise mixtures of any number of compounds with favorable thermodynamic characteristics and solubility. In a particularly preferred embodiment, the fluid comprises a mixture of water and ammonia.

Figure 1B:
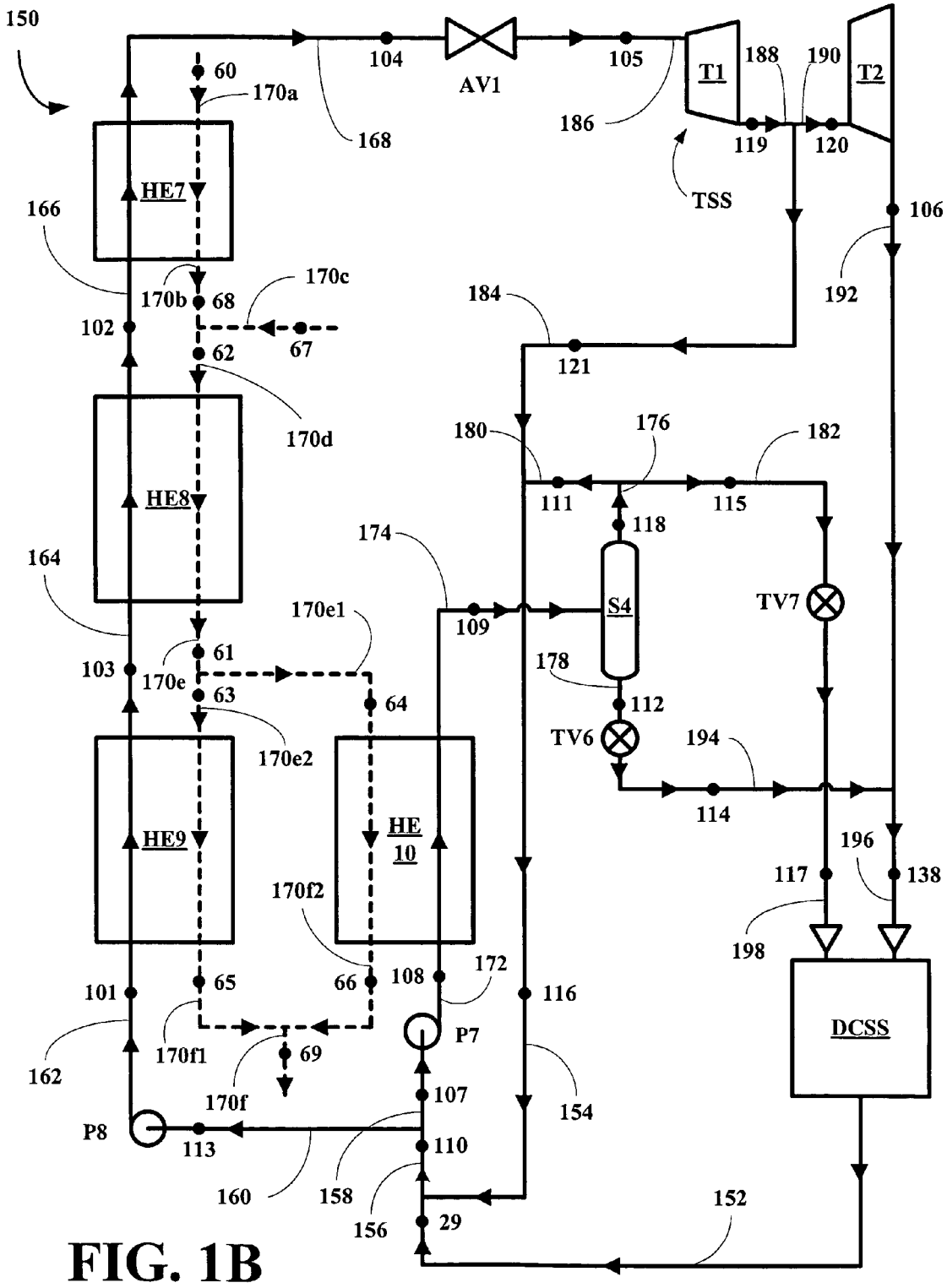
FIG. 1B depicts a block diagram of configuration of the power system of FIG. 1A, used to calculate system efficiency data and stream parameter data.
Figure 2:
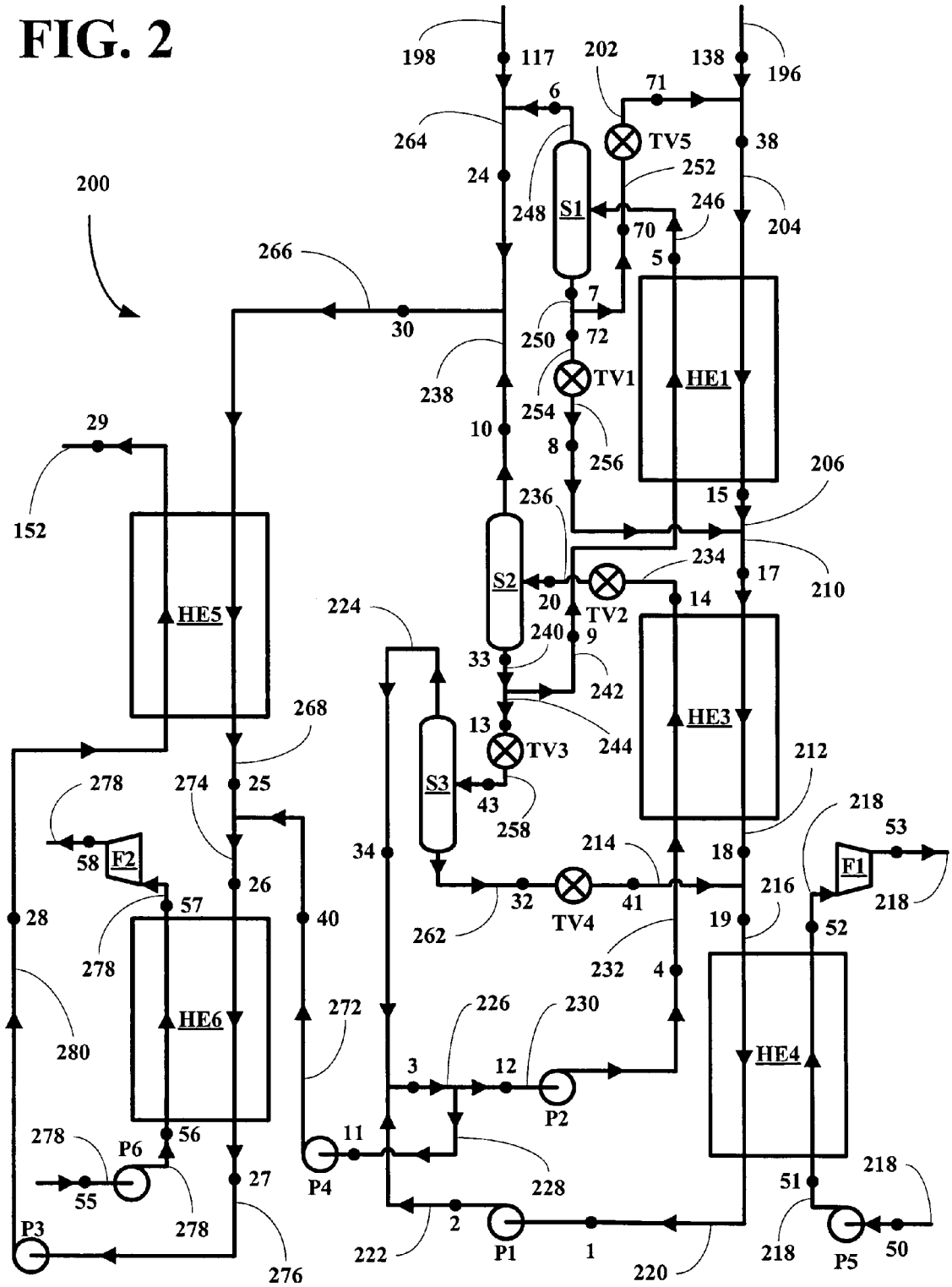
FIG. 2 depicts a block diagram of a preferred distillation-condensation subsystem of this invention.

A conceptual flow diagram of a preferred embodiment of a boiler-turbine subsystem of a power system of this invention, generally 100, is shown in FIG. 1A. (Note that in the conceptual flow diagram, the distillation-condensation subsystem is represented as a box marked DCSS.) A conceptual flow diagram of the preferred embodiment of FIG. 1A for the purposes of calculating stream properties and system efficiencies is shown in FIG. 1B; thus, the boiler in FIG. 1A is broken up into four separate heat exchangers isolating the heat exchange terms for computational simplicity. Clearly, a system can be constructed utilizing the four separate heat exchangers, but it is more cost effective to build a single multi-purpose boiler than to break a single boiler it into four separate heat exchangers. However, design criteria can also be satisfied by dividing the single boiler of FIG. 1A into two boilers, a low temperature boiler and high temperature boiler, with minor to no changes in system performance. Alternatively, in cases where multiple waste heat streams are to be utilized, a single multiport (multiple waste heat stream inputs as shown in FIG. 1A) boiler can be replaced by a plurality of parallel configured boilers one for each waste heat stream or a plurality of multiport single boiler capable of handling a small plurality of waste heat streams (between 2 and 4 streams). A conceptual flow diagram of a preferred embodiment of a Distillation-Condensation Subsystem (DCSS) of this invention, generally 200, is shown in FIG. 2.

Referring now to FIG. 1A, the preferred embodiment of a power system of this invention, generally 150, is shown to include a distillation-condensation subsystem DCSS, from which exits a stream 152 of a fully condensed and enriched solution of working fluid having parameters as at a point 29. The stream 152 exits the DCSS having a desired high pressure and a composition referred to as an "initial working solution." The liquid stream 152 having the parameters as at the point 29 is mixed with a stream 154 of vapor having parameters as at a point 116. Because the liquid stream 152 having the parameters as at the point 29 is subcooled, it is capable of fully absorbing the vapor stream 154 having the parameters as at the point 116, and as a result of mixing, a stream 156 is obtained having parameters as at a point 110. As a result of the mixing of streams 152 and 154 having the parameters as at the points 29 and 116, respectively, the stream 156 having the parameters as at the point 110 has a substantially higher temperature and is richer in a lower boiling component of the multi-component working fluid as compared to the initial working solution stream 152 having the parameters as at the point 29. The composition of the stream 156 having the parameters as at the point 110 is referred to herein as the "working solution." Thereafter, the working solution stream 156 having parameters as at a point 110 is divided into two working solution substreams 158 and 160 having parameters as at points 107 and 113, respectively. The working solution stream 160 having the parameters as at the point 113 is pumped by pump P8, to a desired higher pressure obtaining a higher pressure working solution stream 162 having parameters as at a point 101. The higher pressure working solution stream 162 having the parameters as at the point 101 is already pre-heated, due to compression and mixing, to a temperature that is sufficient to prevent precipitation of any corrosive components in one or more flue gas heat source streams used to boil and super-heat the higher pressure working solution stream 162 having parameters as at the point 101 as described above. The higher pressure working solution stream 162 having parameters as at the point 101 enters into a Boiler, where it is initially heated to a temperature corresponding to its boiling point in a lower section B1 of the Boiler, to form a heated higher pressure working stream 164 having parameters as at a point 103. The heated higher pressure working solution stream 164 having the parameters as at the point 103 is further heated in an upper section B2 of the Boiler producing a superheated higher pressure working solution stream 166 having parameter as at a point 102. The superheated working solution stream 166 having the parameters as at the point 102, which is now fully evaporated is superheated, exits the Boiler as a superheated vapor working solution stream 168 having parameters as at a point 104.

The working solution stream 162 having the parameters as at the point 101 is converted to the working solution stream 168 having the parameters as at the stream 104 in the Boiler via one or more flue gas streams. In the design of FIG. 1A, a flue gas stream 170*a* having initial parameters as at point 60 enters into the upper section B2 of the Boiler, where it is cooled, releasing heat in a heat exchange process 101–104, to produce a spent flue gas stream 170*f* having final parameters as at a point 69, which exits form the lower section B1 of the Boiler. Under appropriate system design specifications, a single boiler as shown here is capable of handling one or multiple flue gas streams from multiple kilns or other flue gas sources. Thus, an additional flue gas stream 170*c* having parameters as at a point 67 can be added the upper section B2 of the Boiler. After the stream 170*a* having the parameters as at the point 60 has entered the upper section B2 of the Boiler and prior to mixing with the additional flue gas stream 170*c*, the stream 170*a* having the parameters as at the point 60 becomes a stream 170*b* having parameters as at a point 68, having transferred a portion of its heat to the stream 166 having parameters as at the point 102. The flue gas streams 170*b* and 170*c* are then combined to form a combined flue gas stream 170*d* having parameters as at a point 62. In the preferred embodiment of the system, temperatures of the streams 170*a–c* at the points 67, 68, and 62 are equal or substantially equal.

Alternatively, the system of this invention can be designed with a boiler for each flue gas stream. In such cases, the working solution stream 162 having the parameters as at the point 101 is divided into an appropriate number of substreams so that each flue gas stream will boil and superheat its designated substeam, and then the substreams are combined to form the stream 168 having parameters as at the point 104. In yet another alternate design, two or more boilers can be used, each boiler having a higher temperature and a lower temperature section and each flue gas stream being introduced into each boiler depending its initial parameters (temperature) and on the heat needed to accomplished the desired working solution heating. Of course, other boiler configuration can be used as well provided that the boiler is capable of accommodating one or a small plurality of waste heat streams, where a small plurality means no more than about 4 streams.

At the point in the Boiler where the flue gas stream 170*c* having the parameter as at the point 67 enters the Boiler, the working solution stream 166 has the parameters as at the point 102. The flue gas stream 170*d* having the parameters as at the point 62 becomes a flue gas stream 170*e* having parameters as at a point 61 at the point in the Boiler apparatus where the working solution stream 164 has the parameters as at the point 103 having transferred heat to the working solution stream 164 having the parameters as at the point 101 forming the working solution stream 166 having the parameters as at the point 102.

The working solution substream 158 having the parameters as at the point 107 as described above is then pumped by pump P7 to an elevated pressure forming an elevated pressure working solution stream 172 having parameters as at a point 108. As was described above, the quantity of heat released by the flue gas stream 170*e* in the low temperature portion B1 of the Boiler (i.e., the portion of the Boiler where the flue gas stream 170 changes its parameters from the point 61 to the point 69) is always greater than the quantity of heat necessary for heating the working solution stream 162 having the parameters as at the point 101 to the heated working solution stream 164 having the parameters as at the point 103 in the heat exchange process 101–103/61–69/108–109, ensuring that corrosive components in the flue gas streams do not precipitate on surfaces of the Boiler, especially the lower section B1 of the Boiler. Therefore, the working solution stream 172 having the parameters as at the point 108 passes through the lower temperature portion B1 of the Boiler and utilizes the excess heat from the flue gas stream 170*e* in the heat exchange process 101–103/61–69/108–109 to form a heated work solution stream 174 having parameters as at a point 109.

In process 101–103/61–69/108–109, the resulting working solution stream 174 having the parameters as at the point 109 is partially vaporized. The mixed working solution stream 174 is then forwarded to a fourth separator S4, where it is separated into a vapor stream 176 having parameters as at a point 118, and into a liquid stream 178 parameters as at a point 112. The flow rate and quantity of the working solution stream 172 having the parameters as at the pont 108 is adjusted to utilize the excess thermal energy in the flue gas stream 170*e*, while ensuring that corrosive flue gas components do not precipitate from the flue gas streams onto surfaces within the Boiler, especially the lower section B1 of the Boiler. The vapor stream 176 having the parameters as at the point 118 is eventually mixed, as the stream 154 having the parameters as at the point 116, with the stream 152 having the parameters as at the point 29 to form the stream 156 having the parameters as at the point as at the point 110 as described above.

Due to changes in the parameters of the flue gas streams and/or the parameters of the coolant streams used in the DCSS described below (i.e., seasonal changes in temperature, changes is kiln firing temperatures, etc.), the quantity of the vapor stream 176 having the parameters as at the point 118 may be in excessive of that needed to heat and enrich the stream 152 having the parameters as at the point 29 to design specification of the working solution 156 having parameters as at the point 110. Thus, under appropriate system operating conditions where the stream 176 having the parameters as at the point 118 is in excess, the enriched vapor stream 176 having the parameters as at the point 118 is divided into two enriched vapor substreams 180 and 182 having parameters as at points 111 and 115, respectively, and the enriched vapor substream 180 having the parameters as at the point 111 is later mixed with the stream 152 having parameters as at the point 29 as described above as the stream 154 having the parameters as at the point 116.

Obviously under appropriate system operating conditions, where the quantity of the vapor stream 176 is not excessive, the whole of the vapor stream 176 having the parameters as at the point 118 is mixed with the stream 152 having the parameters as at the point 29 and the stream 182 having the parameters as at the point 115 does not exist, i.e., the stream 182 having the parameters as at the point 115 has flow rate equal to 0. The system of this invention is designed with controllers that operate to split the vapor stream 176 into the substreams 180 and 182 or not depending system requirements. Thus, in the winter when coolant streams have increased cooling capacity, the system automatically adjusts the quantity of vapor stream 154 mixed with the stream 152 so that the stream 152 fully absorbs the stream 154 and obtains the parameters required from proper operation of the Boiler.

Under other system operating conditions, the entire stream 176 having the parameters as at the point 118 is not sufficient to heat and enrich the stream 152 having the parameter as at the point 29 to a required degree. Under such conditions, the system automatically compensates and the flow rate of the stream 182 having the parameters as at the point 115 again goes to zero (i.e., the stream 182 does not exist). To make up for the deficiency in the stream 176 having the parameters as at the point 118 now identical to the stream 180 having the parameters as at the point 111, a stream 184 having parameters as at a point 121 is split or extracted from an intermediate stage of a turbine subsystem TSS as described below. It should be recognized by an ordinary artisan, that the turbine subsystem TSS does not need to be two separate turbines (a higher pressure turbine and a lower pressure turbine), but is generally a single turbine with an intermediate extraction point.

The streams 180 and 184 having the parameters as at the points 111 and 121, respectively, are then mixed to form the stream 154 having the parameters as at the point 116, which in its turn is mixed with the initial working solution stream 152 having the parameters as at the point 29 forming the working solution stream 156 having parameters as at the point 110 as described above.

The working solution stream 168 having the parameters as at the point 104 exiting the Boiler as described above, now passes through an admission valve AV1 and is converted into a pre-extraction working solution stream 186 having parameters as at a point 105. The admission valve AV1 is designed to control a flow rate of the stream 186 having the parameters as at the point 105 to the TSS. The stream 186 having the parameters as at the point 105 enters into a higher pressure portion T1 of the TSS, where it is expanded converting thermal energy into usable mechanical and/or electrical energy and producing a partially spent stream 188 having parameters as at a point 119. At this point, when then stream 184 having the parameters as at the point 121 is required (the system automatically adjusting the stream flow rates), a portion of vapor stream 188 having the parameters as at the point 119 is extracted or split therefrom forming the stream 184 having the parameters as at the point 121. A remaining portion of vapor stream 190 having parameters as at a point 120 is forwarded to a lower pressure portion T2 of the TSS where it is further expanded, converting further thermal energy into usable mechanical and/or electrical energy, and exits the TSS as a spent working solution stream 192 having parameters as at a point 106. Under circumstances where the stream 184 having the parameters as at the point 121 is not needed (i.e., the stream 180 having the parameters as at the point 111 is sufficient or more than sufficient to heat and enrich the stream 152 having the parameters as at point 29), the stream 188 having the parameters as at the point 119 is not divided and the entire stream is forwarded to the lower pressure portion T2 of the TSS, i.e., streams 188 and 190 are identical.

The liquid stream 178 having the parameters as at the point 112 from the fourth separator S4 as described above is then passed through a throttle valve TV6 where its pressure is reduced to a pressure equal to a pressure of the spent working solution stream 192 having the parameters as at the point 106 forming a reduced pressure lean stream 194 having parameters as at a point 114. The streams 192 and 194 having the parameters as at the points 106 and 114, respectively, are then mixed to forming a stream 196 having parameters as at a point 138. A concentration of the lower boiling component in the stream 196 having parameters as at the point 138 is less than a concentration of the lower boiling component in the working solution and equal or substantially equal to a concentration of the lower boiling component in the initial working solution stream 152 having the parameters as at the point 29.

As a result of utilizing the lower temperature portion B1 of the available heat in the heat exchange process 101–103/61–69/108–109 in the Boiler, the concentration of the lower boiling component in the stream 196 having the parameters as at the point 138, entering into the DCSS, and the stream 152 having the parameters as at the point 29 exiting from the DCSS are lower than the concentration of the lower boiling component of the working solution. Due to this fact, the DCSS can accommodate a lower pressure to the stream 196 having the parameters as at the point 138 and correspondingly to the stream 192 having the parameters as at the point 106, and thus increasing the power output of the turbine subsystem TSS.

Under system operating conditions where the stream 182 having the parameters as at the point 115 is required, it passes through a throttle valve TV7 where its pressure is reduced forming a stream 198 having parameters as at a point 117, which in its turn enters into the DCSS. The stream 198 having the parameters as at the point 117 is always richer than the working solution, and even richer than the initial working solution stream 152 having parameters as at the point 29. Therefore, this stream 198 having the parameters as at the point 117 delivers additional heat and an additional rich vapor to the DCSS, enabling the DCSS to handle streams having reduced operating pressure (streams 192 and 196), with a corresponding increase of power output from the turbine subsystem (TSS).

It should be noted that where the stream 67 is shown entering into the Boiler of FIG. 1A, two boilers with different initial temperatures of flue gas can be used to heat working solution streams to parameters identical to the stream having the parameters as at point 102. The resulting streams can then be mixed creating a combined stream having parameters as at the point 102. This has the same effect as introducing the stream 170*c* of flue gas having the parameters as at point 67. That is, the system can be designed with multiple boilers, each boiler handling one or more flue gas streams with differing properties or with multiple boilers, one for each flue gas stream.

Referring now to FIG. 1B, the system of FIG. 1A has been reformulated to divide the Boiler of FIG. 1A into four independent heat exchangers HE7–10 for ease of calculating stream and point parameters and overall system performance properties. In the embodiment of FIG. 1B, the flue gas stream 170*e* is divided into two substreams 170*e*1 and 170*e*2, which are then recombined after passing through heat exchangers HE10 and HE9, respectively, forming streams 170*f*1 and 170*f*2 which are then combined into the stream 170*f*. Again, the system can actually be built utilizing this arrangement of heat exchangers, but at an added cost.

Referring now the FIG. 2, a conceptual flow diagram of a preferred embodiment of the Distillation-Condensation Subsystem (DCSS) 200 of FIGS. 1A&B is shown with the stream 196 having parameters as at point 138 entering the DCSS. Under operating system conditions where the stream 196 having parameter as at the point 138 corresponds to a state of superheated vapor, the stream 196 having parameter as at the point 138 is mixed with a liquid stream 202 having parameters as at a point 71 as described more fully below, creating a stream 204 having parameters as at a point 38, which is in a state of saturated or wet vapor. Under operating conditions where the parameters of the stream 196 having parameters as at the point 138 correspond to a state of saturated or wet vapor, the flow rate of the stream 202 having the parameters as at the point 71 is equal to zero, and the parameters of the streams 196 and 202 at the points 138 and 38 are identical. Thus, the DCSS is designed to adjusts to changing input conditions, i.e., the DCSS will introduce the liquid stream 202 having the parameters as at the point 71 to the stream 196 having the parameters as at the point 138 if the stream 196 is a superheated vapor.

The vapor stream 204 having parameters as at the point 38 then passes through a first heat exchanger HE1, where it is cooled and partially condensed, releasing heat, and exits the first heat exchanger HE1 as a stream 206 having parameters as at a point 15. The stream 206 having the parameters as at the point 15 is then mixed with a stream 208 having parameters as at a point 8 as described below, and forms a stream 210 having parameters as at a point 17. The stream 210 having the parameters as at the point 17 enters into a third heat exchanger HE3, where it is further cooled and further condensed, releasing heat, and exits from the third heat exchanger HE3 as a stream 212 having parameters as at a point 18. Thereafter, an additional stream 214 having parameters as at a point 41 is mixed with the stream 212 having parameters as at the point 18 forming a stream 216 having parameters as at a point 19. The stream 216 having the parameters as at the point 19 enters into a condenser or fourth heat exchanger HE4, where it is cooled in counterflow by a steam of water or air 218 having initial parameters as at a point 51 and final parameters as at a 52, and fully condensed, forming a stream 220 having parameters as at a point 1.

The stream 220 having the parameters as at the point 1 referred to a "basic solution" is pumped by a pump P1 to a necessary intermediate pressure forming a stream 222 having parameters as at a point 2. Thereafter, the basic solution stream 222 having the parameters as at the point 2 is combined with a saturated vapor stream 224 having parameters as at a point 34, forming a saturated liquid or slightly subcooled liquid stream 226 having parameters as at a point 3. Flow rates and pressures of the streams 222 and 224 having parameters as at the points 2 and 34, respectively, are chosen in such a way that the stream 222 having the parameters as at the point 2, which is in a state of subcooled liquid, fully absorbs the vapor stream 224 having the parameters as at the point 34, thus forming the stream 226 having parameters as at the point 3.

Thereafter, the stream 226 with parameters as at the point 3 is divided into two substreams 228 and 230 having parameters as at points 11 and 12, respectively. The stream 230 having parameters as at the point 12 is then pumped by a pump P2 to an elevated pressure forming a stream 232 having parameters as at a point 4. Thereafter, the stream 232 having the parameters as at the point 4 passes through the third heat exchanger HE3 where it is heated in counter flow by the condensing stream 210 having parameters as at the points 17, as described above, to form a stream 234 having parameters as at a point 14, corresponding to a state of saturated or slightly subcooled liquid and the stream 212 having the parameters as at the point 18.

The stream 234 having the parameters as at the point 14 is then sent through a second throttle valve TV2 forming a reduced pressure stream 236 having parameters as at a point 20. The pressure of the stream 236 having the parameters as at the point 20 is reduced to a pressure that slightly exceeds a pressure necessary for complete condensation of a stream having a composition equal to the composition of the stream 152 having parameters as at the point 29, i.e., a stream of the "initial working solution" as described above.

The stream 236 having the parameters a at the point 20 is in a state of a vapor-liquid mixture. The stream 236 having the parameters a at the point 20 is then forwarded to a second separator S2, where it is separated into a vapor stream of vapor 238 having parameters as at a point 10 and a liquid stream 240 having parameters as at a point 33. The liquid stream 240 having the parameters as at the point 33 is then divided into two substreams 242 and 244 having parameters as at points 9 and 13, respectively. The stream 242 having parameters as at the point 9, corresponding to a state of saturated liquid, then passes through the first heat exchange HE1, where it is heated and partially vaporized by heat released in a process 38-15 as described above producing a stream 246 having parameters as at a point 5. Thereafter, the stream 246 having the parameters as at the point 5 enters into a first separator S1, where it is separated into a vapor stream 248 having parameters as at a point 6 and a liquid stream 250 having parameters as at a point 7. The liquid stream 250 having the parameters as at the point 7 is in turn divided into two substreams 252 and 254 having parameters as at points 70 and 72, respectively. The stream 252 having the parameters as at the point 70 then passes through it a fifth throttle valve TV5 forming the stream 202 having the parameters as at the point 71. The stream 202 having parameters as at the point 71 has its pressure reduced to a pressure equal to a pressure of the stream 196 having the parameters as at the point 138 and it is then mixed with the stream 196 having the parameters as at the point 138 as described above. Because the system is automatically controlled to function is all climatic conditions and flue gas conditions (temperature changes during the four seasons), the streams 250 and 202 having the parameters as at the points 70 and 71, respectively, exist only if the stream 196 having the parameter as at the point 138 is in a state of superheated vapor. Thus, the system adjusts the flow rates of the streams 250 and 202 depending on the initial conditions of the stream 196 having the parameters as at the point 138.

The liquid stream 254 having the parameters as at the point 72 then passes through a first throttle valve TV1, where its pressure is reduced to a pressure equal to a pressure of the stream 206 having the parameters as at the point 15, forming the stream 208 having parameters as at the point 8. Then, the stream 208 having the parameters as at the point 8 is mixed with the stream 206 having the parameters as at the point 15 forming the stream 210 having parameters as at the point 17 as described above.

The liquid stream 244 having parameters as at point 13 as described above then passes through a third throttle valve TV3 forming a stream 258 having parameters as at a point 43. The pressure of the stream 258 having the parameters as at the point 43 is reduced to a pressure equal to a pressure of the stream 222 having parameters as at the point 2 as described above. The stream 258 having the parameters as at the point 43, which is in a state of a vapor-liquid mixture, then enters into a third separator S3, where it is separated into the vapor stream 224 having the parameters as at the point 34 and a liquid stream 262 having parameters as at point 32. The vapor stream 224 having the parameters as at the point 34 is then mixed with the liquid stream 222 having the parameters as at the point 2, forming the stream 226 having the parameters as at the point 3 as described above. The liquid stream 262 of having parameters as at the point 32 then passes through a fourth throttle valve TV4 forming the stream 214 having the parameters as at the point 41. The stream 214 having the parameters as at the point 41 has its pressure is reduced to a pressure equal to a pressure of the stream 212 having the parameters as at the point 18. The stream 214 having the parameters as at the point 41 is then mixed with the stream 212 having the parameters as at the point 18, forming the stream 216 having the parameters as at the point 19 as described above.

The vapor stream 248 having the parameters as at the point 6 exiting from the first separator S1, and is mixed with the vapor stream 198 having the parameters as at the point 117, forming a stream 264 having parameters as at a point 24. In a case that the stream 198 having the parameters as at the point 117 does not exist, then the streams 248 and 264 having the parameters at the points 6 and 24 are the same stream.

Thereafter, the vapor stream 264 having parameters as at the point 24 is mixed with the vapor stream 238 having the parameters as at the point 10 exiting the second separator S2 forming a stream 266 having parameters as at a point 30.

The stream 266 having parameters as at the point 30 passes through a fifth heat exchanger HE5, where it is cooled and partially condensed forming a stream 268 parameters as at a point 25 in counter flow with a liquid stream 270 having the parameters as at a point 28 which is heated to form the initial working solution stream 152 having the parameters as at the point 29. The liquid stream 228 having the parameters as at the point 11 as described above is pumped by a fourth pump P4 to a pressure equal to a pressure of the stream 268 having the parameters as at the point 25, forming a higher pressure stream 272 having parameters as at a point 40. Thereafter, the stream 272 having the parameters as at the point 40 is mixed with the stream 268 having the parameters as at the point 25 forming a stream 274 having parameters as at a point 26. A composition of the stream 274 having the parameters as at the point 26 is the same as a composition of the basic solution stream 222 having the parameters as at the point 2 as described above. The stream 274 having the parameters as at the point 26 then enters into a sixth heat exchanger HE6, where it is cooled and fully condensed forming a stream 276 having parameters as at a point 27 transferring heat in counter flow to an air or water stream 278 having initial parameter as at a point 56 and final parameters as at a point 57. The fully condensed liquid stream 276 is then pumped by a third pump P3 to a required higher pressure forming the stream 270 having the parameters as at the point 28. The liquid stream 270 having the parameters as at the point 28 then passes through the fifth heat exchanger HE5 in counter flow with the stream 266 having parameters as at the point 30, where it is heated forming the initial working solution stream 152 having the parameters as at the point 29 as described above.

As noted above, the final condensers, HE4 and HE6, of the DCSS can be cooled by air or water. In the case of air cooling, the air streams 218 and/or 278 enter the fourth and sixth heat exchangers HE4 and HE6 having parameters as at points 51 and 56, respectively, and are then, after passing through the heat exchangers, sent into induction fans F1 and F2, respectively, where their pressure is increased to an atmospheric level, and the air streams 218 and 278 having parameters as at the points 53 and 58 are discharged into the atmosphere. In the case of water cooling, the water streams 218 and/or 278 having parameters as at a points 50 and 55, respectively, are sent into a fifth pumps P5 and a sixth pump P6, respectively, where the water streams 218 and 278 are pumped to a necessary pressure obtaining parameters as at the points 51 and 56, respectively. After passing through the heat exchangers HE4 and HE6, respectively, the water streams 218 and 278 obtain parameters as at the points 52 and 57, and sent to a cooling tower or discharged.

It should be recognized by persons of ordinary skill in the art that the apparatus of this inventions also includes stream mixer valves and stream splitter valves which are designed to combine stream and split streams, respectively.

In comparison with the prior art, the system of this invention has a higher efficiency and a substantially simplified and streamlined design of the DCSS. Eventhough the prior art is substantially more efficient than the commonly used power systems based on the Rankinc cycle. Computation has shown that the system of this invention, at the same boundary conditions, has a power output that is 1.4 times higher than the prior art.

To illustrate the operation of the system of this invention, the computed parameters of operation of such a system for utilizing waste heat from two cement kilns is presented in Tables I and II. The summary of performance is presented in Table I. The parameters of the streams of the working fluid at key points in the system are shown in Table II.

TABLE I

Plant Performance Summary for an Ammonia-Water Working Fluid

| | | |
|---|---|---|
| Heat in | 12,314.77 kW | 1,759.49 Btu/lb |
| Heat rejected | 8,949.33 kW | 1,278.65 Btu/lb |
| Turbine enthalpy Drops | 3,536.77 kW | 505.32 Btu/lb |
| Gross Generator Power | 3,372.49 kW | 481.85 Btu/lb |
| Process Pumps (−24.48) | −198.60 kW | −28.12 Btu/lb |
| Cycle Output | 3,175.69 kW | 453.73 Btu/lb |
| Other Pumps and Fans (−30.07) | −228.43 kW | −32.64 Btu/lb |
| Net Output | 2,947.26 kW | 421.09 Btu/lb |
| Gross Generator Power | 3,372.49 kW | 481.85 Btu/lb |
| Cycle Output | 3,175.69 kW | 453.73 Btu/lb |
| Net Output | 2,947.26 kW | 421.09 Btu/lb |
| Net Thermal Efficiency | 23.93% | |
| Second Law Limit | 42.09% | |
| Second Law Efficiency | 56.86% | |
| Specific Brine Consumption | 54.51 lb/kW-hr | |
| Specific Power Output | 18.34 W-hr/lb | |

OVERALL HEAT BALANCE

| | Btu/lb |
|---|---|
| Heat in: (Brine + pumps) | 1,759.49 + 24.48 = 1,783.97 |
| Heat out: (Turbines + condenser) | 505.32 + 1,278.65 = 1,783.97 |

TABLE II

Physical Parameters of Working Fluid, Heat Source and Coolant Streams

| Point | X lb/lb | T ° F. | P psia | H Btu/lb | S Btu/lb-R | Grel G/G = 1 | Gabs lb/h | Ph | Wetness lb/lb or T |
|---|---|---|---|---|---|---|---|---|---|
| Multi-Component Fluid Streams | | | | | | | | | |
| 1 | 0.4878 | 94.00 | 60.453 | −41.45 | 0.0715 | 9.93192 | 237,350 | m[a] | 1 |
| 2 | 0.4878 | 94.13 | 87.991 | −41.24 | 0.0717 | 9.93192 | 237,350 | l[b] | −21.61° F. |
| 3 | 0.5033 | 111.46 | 87.991 | −21.55 | 0.1062 | 10.2477 | 244,896 | l | −0.01° F. |
| 4 | 0.5033 | 111.81 | 221.015 | −20.86 | 0.1065 | 9.39064 | 224,415 | l | −62.72° F. |
| 5 | 0.4801 | 215.64 | 139.959 | 279.54 | 0.5831 | 1.83656 | 43,889 | m | 0.6999 |

TABLE II-continued

Physical Parameters of Working Fluid, Heat Source and Coolant Streams

| Point | X lb/lb | T ° F. | P psia | H Btu/lb | S Btu/lb-R | Grel G/G = 1 | Gabs lb/h | Ph | Wetness lb/lb or T |
|---|---|---|---|---|---|---|---|---|---|
| 6 | 0.9174 | 215.64 | 139.959 | 679.98 | 1.2396 | 0.55120 | 13,172 | m | 0 |
| 7 | 0.2925 | 215.64 | 139.959 | 107.83 | 0.3015 | 1.28536 | 30,717 | m | 1 |
| 8 | 0.2925 | 175.94 | 61.703 | 107.83 | 0.3049 | 1.28536 | 30,717 | m | 0.9382 |
| 9 | 0.4801 | 148.50 | 140.959 | 19.95 | 0.1770 | 1.83656 | 43,889 | m | 1 |
| 10 | 0.9900 | 148.50 | 140.959 | 605.18 | 1.1294 | 0.42802 | 10,229 | m | 0 |
| 11 | 0.5033 | 111.46 | 87.991 | −21.55 | 0.1062 | 0.85702 | 20,481 | l | −0.01° F. |
| 12 | 0.5033 | 111.46 | 87.991 | −21.55 | 0.1062 | 9.39064 | 224,415 | l | −0.01° F. |
| 13 | 0.4801 | 148.50 | 140.959 | 19.95 | 0.1770 | 7.12606 | 170,297 | m | 1 |
| 14 | 0.5033 | 170.94 | 211.015 | 46.63 | 0.2189 | 9.39064 | 224,415 | m | 1 |
| 15 | 0.7411 | 175.94 | 61.703 | 509.22 | 1.0273 | 1.83624 | 43,882 | m | 0.2644 |
| 17 | 0.5564 | 175.94 | 61.703 | 343.94 | 0.7299 | 3.12159 | 74,599 | m | 0.5418 |
| 18 | 0.5564 | 117.53 | 61.203 | 140.93 | 0.3952 | 3.12159 | 74,599 | m | 0.7481 |
| 19 | 0.4878 | 110.86 | 61.203 | 39.60 | 0.2158 | 9.93192 | 237,350 | m | 0.9003 |
| 20 | 0.5033 | 148.50 | 140.959 | 46.63 | 0.2204 | 9.39064 | 224,415 | m | 0.9544 |
| 24 | 0.9154 | 217.54 | 139.959 | 682.09 | 1.2424 | 0.58073 | 13,878 | v[c] | 0.9° F. |
| 25 | 0.9470 | 101.46 | 139.959 | 473.64 | 0.9089 | 1.00875 | 24,107 | m | 0.1675 |
| 26 | 0.7432 | 126.11 | 139.959 | 246.36 | 0.5422 | 1.86577 | 44,588 | m | 0.5801 |
| 27 | 0.7432 | 94.00 | 138.709 | −7.51 | 0.0936 | 1.86577 | 44,588 | m | 1 |
| 28 | 0.7432 | 95.43 | 565.635 | −5.04 | 0.0948 | 1.86577 | 44,588 | l | −106.15° F. |
| 29 | 0.7432 | 175.86 | 565.595 | 90.02 | 0.2546 | 1.86577 | 44,588 | l | −25.72° F. |
| 30 | 0.9470 | 196.42 | 139.959 | 649.46 | 1.1975 | 1.00875 | 24,107 | m | 0.0059 |
| 32 | 0.4564 | 124.91 | 87.991 | −6.84 | 0.1326 | 6.81032 | 162,751 | m | 1 |
| 33 | 0.4801 | 148.50 | 140.959 | 19.95 | 0.1770 | 8.96262 | 214,186 | m | 1 |
| 34 | 0.9915 | 124.91 | 87.991 | 597.90 | 1.1690 | 0.31574 | 7,545 | m | 0 |
| 38 | 0.7411 | 220.64 | 62.203 | 768.85 | 1.4193 | 1.83624 | 43,882 | m | 0.0097 |
| 40 | 0.5033 | 111.69 | 139.459 | −21.17 | 0.1065 | 0.85702 | 20,481 | l | −29.3° F. |
| 41 | 0.4564 | 108.35 | 61.203 | −6.84 | 0.1333 | 6.81032 | 162,751 | m | 0.9707 |
| 43 | 0.4801 | 124.91 | 87.991 | 19.95 | 0.1785 | 7.12606 | 170,297 | m | 0.9557 |
| 70 | 0.2925 | 215.64 | 139.959 | 107.83 | 0.3015 | 0.00000 | 0 | m | 1 |
| 71 | 0.2925 | 176.30 | 62.203 | 107.83 | 0.3049 | 0.00000 | 0 | m | 0.9387 |
| 72 | 0.2925 | 215.64 | 139.959 | 107.83 | 0.3015 | 1.28536 | 30,717 | m | 1 |
| 101 | 0.7500 | 205.00 | 1,605.000 | 128.21 | 0.3046 | 1.79453 | 42,885 | l | −115.67° F. |
| 102 | 0.7500 | 677.17 | 1,521.650 | 985.55 | 1.3216 | 1.79453 | 42,885 | v | 243.5° F. |
| 103 | 0.7500 | 316.15 | 1,555.000 | 281.62 | 0.5176 | 1.79453 | 42,885 | m | 1 |
| 104 | 0.7500 | 781.00 | 1,505.000 | 1,063.19 | 1.3881 | 1.79453 | 42,885 | v | 348.1° F. |
| 105 | 0.7500 | 780.80 | 1,500.000 | 1,063.19 | 1.3885 | 1.79453 | 42,885 | v | 348.2° F. |
| 106 | 0.7500 | 235.37 | 62.203 | 781.60 | 1.4406 | 1.79453 | 42,885 | v | 15.3° F. |
| 107 | 0.7500 | 200.34 | 565.595 | 122.11 | 0.3028 | 0.17110 | 4,089 | l | −0.18° F. |
| 108 | 0.7500 | 200.45 | 575.595 | 122.25 | 0.3030 | 0.17110 | 4,089 | l | −1.71° F. |
| 109 | 0.7500 | 316.15 | 565.595 | 599.37 | 0.9785 | 0.17110 | 4,089 | m | 0.2437 |
| 110 | 0.7500 | 200.34 | 565.595 | 122.11 | 0.3028 | 1.96563 | 46,974 | l | −0.18° F. |
| 111 | 0.8766 | 316.15 | 565.595 | 721.58 | 1.1453 | 0.09987 | 2,387 | m | 0 |
| 112 | 0.3571 | 316.15 | 565.595 | 220.20 | 0.4610 | 0.04170 | 997 | m | 1 |
| 113 | 0.7500 | 200.34 | 565.595 | 122.11 | 0.3028 | 1.79453 | 42,885 | l | −0.18° F. |
| 114 | 0.3571 | 190.24 | 62.203 | 220.20 | 0.4937 | 0.04170 | 997 | m | 0.7886 |
| 115 | 0.8766 | 316.15 | 565.595 | 721.58 | 1.1453 | 0.02953 | 706 | m | 0 |
| 116 | 0.8766 | 316.15 | 565.595 | 721.58 | 1.1453 | 0.09987 | 2,387 | m | 0 |
| 117 | 0.8766 | 316.15 | 139.959 | 721.58 | 1.1453 | 0.02953 | 706 | m | 0 |
| 118 | 0.8766 | 316.15 | 565.595 | 721.58 | 1.1453 | 0.12940 | 3,092 | m | 0 |
| 119 | 0.7500 | 584.87 | 565.595 | 959.40 | 1.4028 | 1.79453 | 42,885 | v | 225.6° F. |
| 120 | 0.7500 | 584.87 | 565.595 | 959.40 | 1.4028 | 1.79453 | 42,885 | v | 225.6° F. |
| 121 | 0.7500 | 584.87 | 565.595 | 959.40 | 1.4028 | 0.00000 | 0 | v | 225.6° F. |
| 129 | 0.7432 | 175.86 | 565.595 | 90.02 | 0.2546 | 1.86577 | 44,588 | l | −25.72° F. |
| 138 | 0.7411 | 220.64 | 62.203 | 768.85 | 1.4193 | 1.83624 | 43,882 | m | 0.0097 |
| | | | | Heat Source Streams | | | | | |
| 60 | Air | 806.00 | 13.193 | 213.09 | 0.7069 | 6.72290 | 160,662 | v | 1120.2° F. |
| 61 | Air | 341.15 | 12.471 | 96.84 | 0.5965 | 13.2233 | 316,007 | v | 656.2° F. |
| 62 | Air | 725.00 | 12.953 | 192.37 | 0.6912 | 13.2233 | 316,007 | v | 1039.5° F. |
| 63 | Air | 341.15 | 12.471 | 96.84 | 0.5965 | 10.1990 | 243,733 | v | 656.2° F. |
| 64 | Air | 341.15 | 12.471 | 96.84 | 0.5965 | 3.02429 | 72,274 | v | 656.2° F. |
| 65 | Air | 230.00 | 11.748 | 69.84 | 0.5643 | 10.1990 | 243,733 | v | 545.9° F. |
| 66 | Air | 230.00 | 11.748 | 69.84 | 0.5643 | 3.02429 | 72,274 | v | 545.9° F. |
| 67 | Air | 725.00 | 13.193 | 192.37 | 0.6900 | 6.50041 | 155,345 | v | 1039.2° F. |
| 68 | Air | 725.00 | 12.953 | 192.37 | 0.6912 | 6.72290 | 160,662 | v | 1039.5° F. |
| 69 | Air | 230.00 | 11.748 | 69.84 | 0.5643 | 13.2233 | 316,007 | v | 545.9° F. |
| | | | | Coolant Streams | | | | | |
| 50 | Air | 80.00 | 14.693 | 33.65 | 0.4898 | 153.0192 | 3,656,809 | v | 392.6° F. |
| 51 | Air | 80.00 | 14.693 | 33.65 | 0.4898 | 153.0192 | 3,656,809 | v | 392.6° F. |
| 52 | Air | 101.86 | 14.653 | 38.92 | 0.4996 | 153.0192 | 3,656,809 | v | 414.5° F. |
| 53 | Air | 102.44 | 14.693 | 39.06 | 0.4996 | 153.0192 | 3,656,809 | v | 415° F. |
| 55 | Air | 80.00 | 14.693 | 33.65 | 0.4898 | 153.0192 | 3,656,809 | v | 392.6° F. |

TABLE II-continued

Physical Parameters of Working Fluid, Heat Source and Coolant Streams

| Point | X lb/lb | T ° F. | P psia | H Btu/lb | S Btu/lb-R | Grel G/G = 1 | Gabs lb/h | Ph | Wetness lb/lb or T |
|---|---|---|---|---|---|---|---|---|---|
| 56 | Air | 80.00 | 14.693 | 33.65 | 0.4898 | 64.7161 | 1,546,566 | v | 392.6° F. |
| 57 | Air | 110.41 | 14.653 | 40.97 | 0.5032 | 64.7161 | 1,546,566 | v | 423° F. |
| 58 | Air | 110.96 | 14.693 | 41.11 | 0.5033 | 153.0192 | 3,656,809 | v | 423.5° F. |

X is the composition of the stream: 1.0 is pure ammonia (lower boiling component), 0.0 is pure water (higher boiling component. [a]m means mixed, [b]l means liquid, and [c]v means vapor.

The data in Tables I and II clearly evidence the improved performance of the system of this invention under a given set of operating conditions. The system is designed to operate under a range of operating conditions depending on the temperature of the flue gas streams and the coolants streams. The system is geared to adjust certain stream flow rates to ensure improved transfer of thermal energy from the heat source streams such as cement kiln streams to the working fluid streams so that more energy can be converted to electrical energy in the turbine subsystem.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

I claim:

1. A system for converting thermal energy to a more usable form of energy comprising:

a boiler subsystem adapted to fully vaporize and superheat a stream of a working solution comprising a desired composition of a multi-component working fluid using one or a plurality of waste heat streams;

a turbine subsystem including a high pressure and a low pressure portion and an intermediate extraction port, where the turbine subsystem is designed to extract energy from the fully vaporized, superheated working solution stream forming a spent stream of the working solution; and a distillation-condensation subsystem including a plurality of heat exchangers designed to efficiently condense one or a plurality of streams into a fully condensed initial working solution stream using one or a plurality of coolant streams.

2. The system of claim 1, wherein the boiler includes a higher temperature portion designed to superheat the working solution stream and a lower temperature portion designed to heat two input working solution streams to an intermediate heated state.

3. The system of claim 1, wherein the multi-component working fluid comprises a lower boiling point component and a higher boiling point component.

4. The system of claim 1, wherein the multi-component working fluid is selected from the group consisting of an ammonia-water mixture, a mixture of two or more hydrocarbons, a mixture of two or more freons, and a mixture of hydrocarbons and freons.

5. The system of claim 1, wherein the multi-component working fluid comprises ammonia and water.

6. The system of claim 1, the distillation-condensation subsystem includes six heat exchanges, four of which transfer thermal energy between streams of the working fluid having the same of or different compositions and two of which transfer heat from two working fluid streams having the same or different compositions to external coolant streams, three separators for separating various working fluid streams having the same or different compositions into vapor streams having the same or different compositions and liquid streams having the same or different compositions, five throttle valves for lowering the pressure of up to five working fluid streams having the same or different compositions, and four pumps for increasing the pressure of four working fluid streams having the same or different compositions, where the system includes controllers sufficient to control stream flow rates to produce an output stream having desired properties.

7. The system of claim 1, wherein the boiling subsystem includes two pumps adapted to increase the pressure of two working solution substreams to the same or different increased pressure, a boiler having a lower temperature portion and a higher temperature portion adapted to heat one of the two working solution substreams to a fully vaporized, superheated working solution stream after passing through both portions of the boiler and to heat the other of the two working solution substreams to an intermediate temperature, a separator for separation the heated other of the two working solution substreams to from a vapor stream and a liquid stream, a throttle valve for lowering a pressure of the liquid stream to a pressure equal to or substantially equal to a pressure of the spent working solution streams so that it can be mixed with the spent working solution stream.

8. The system of claim 1, wherein the waste heat streams are flue gas streams from kilns or other furnaces.

9. A method for extracting energy from waste heat source stream comprising the steps of:

forming a stream of a working fluid formed in a distillation-condensation subsystem, where the working fluid comprises one or a plurality of lower boiling components and one or a plurality of higher boiling components and where the stream is fully condensed and has an initial working solution composition;

mixing the initial working solution composition stream with a vapor stream having a higher concentration of one or more of the lower boiling components of the working fluid to form an enriched stream having a working solution composition;

splitting the working solution composition stream into two substreams;

pumping each substream of individual higher pressures;

forwarding each higher pressure substream to a lower temperature portion of the boiler where each substream is heated by one or a plurality of waste heat streams where temperatures of the two substreams are greater than a condensation temperature of a least volatile corrosive component of the waste heat streams;

heating each substream to form mixed gas-liquid streams;

separating one of the mixed substream into a first liquid stream and the vapor stream;

heating the other mixed substream in the boiler to form a superheated working solution composition vapor stream;

expanding the superheated working solution composition vapor stream in a turbine subsystem, where a portion of thermal energy is converted into a more usable form of energy to form a spent working solution composition stream;

reducing a pressure of the liquid stream to a pressure equal to or substantially equal to a pressure of the spent working solution composition stream to form a reduced pressure stream;

mixing the reduced pressure stream with the spent working solution composition stream to form a combined stream; and condensing the combined stream in the distillation-condensation subsystem to form the initial working solution composition stream.

10. The method of claim 9, wherein the multi-component working fluid comprises a lower boiling point component and a higher boiling point component.

11. The method of claim 9, wherein the multi-component working fluid is selected from the group consisting of an ammonia-water mixture, a mixture of two or more hydrocarbons, a mixture of two or more freons, and a mixture of hydrocarbons and freons.

12. The method of claim 9, wherein the multi-component working fluid comprises ammonia and water.

13. The method of claim 9, further comprising the step of:

adjusting flow rates of one or more streams in the boiler subsystem, the turbine subsystem and the distillation-condensation subsystem depending on changes in temperature and composition of the waste heat stream, temperature of coolants streams and temperature and composition of the working solution stream sufficient to optimize energy extraction and to prevent any corrosive components in the waste heat streams from condensing on surfaces in the boiler.

14. The method of claim 9, wherein the waste heat streams are flue gas streams from kilns or other furnaces.

15. A system for converting thermal energy to a more usable form of energy comprising:

a boiler subsystem adapted to fully vaporize and superheat a stream of a working solution comprising a desired composition of a multi-component working fluid using one or a plurality of waste heat streams;

a turbine subsystem including a high pressure and a low pressure portion and an intermediate extraction port, where the turbine subsystem is designed to extract energy from the fully vaporized, superheated working solution stream forming a spent stream of the working solution; and a distillation-condensation subsystem including a plurality of heat exchangers designed to efficiently condense one or a plurality of streams into a fully condensed initial working solution using one or a plurality of coolant streams, where the intermediate extraction port of the turbine subsystem is designed to withdraw a portion of an intermediate spent stream, which is mixed with a portion of a separator vapor stream and then combined with the fully condensed initial working solution to form the working solution.

16. The system of claim 15, wherein the boiler includes a higher temperature portion designed to superheat the working solution stream and a lower temperature portion designed to heat two input working solution streams to an intermediate heated state.

17. The system of claim 15, wherein the multi-component working fluid comprises a lower boiling point component and a higher boiling point component.

18. The system of claim 15, wherein the multi-component working fluid is selected from the group consisting of an ammonia-water mixture, a mixture of two or more hydrocarbons, a mixture of two or more freons, and a mixture of hydrocarbons and freons.

19. The system of claim 15, wherein the multi-component working fluid comprises ammonia and water.

20. The system of claim 15, the distillation-condensation subsystem includes six heat exchanges, four of which transfer thermal energy between streams of the working fluid having the same or different compositions and two of which transfer heat from two working fluid streams having the same or different compositions to external coolant streams, three separators for separating various working fluid streams having the same or different compositions into vapor streams having the same or different compositions and liquid streams having the same or different compositions, five throttle valves for lowering the pressure of up to five working fluid streams having the same or different compositions, and four pumps for increasing the pressure of four working fluid streams having the same or different compositions, where the system includes controllers sufficient to control stream flow rates to produce an output stream having desired properties.

21. The system of claim 15, wherein the boiling subsystem includes two pumps adapted to increase the pressure of two working solution substreams to the same or different increased pressure, a boiler having a lower temperature portion and a higher temperature portion adapted to heat one of the two working solution substreams to a fully vaporized, superheated working solution stream after passing through both portions of the boiler and to heat the other of the two working solution substreams to an intermediate temperature, a separator for separation the heated other of the two working solution substreams to from a vapor stream and a liquid stream, a throttle valve for lowering a pressure of the liquid stream to a pressure equal to or substantially equal to a pressure of the spent working solution streams so that it can be mixed with the spent working solution stream.

22. The system of claim 15, wherein the waste heat streams are flue gas streams from kilns or other furnaces.

* * * * *